US007296761B1

(12) United States Patent
Laible

(10) Patent No.: US 7,296,761 B1
(45) Date of Patent: Nov. 20, 2007

(54) HAND-HELD DISPENSER

(76) Inventor: Rodney Laible, P.O. Box 12278, Omaha, NE (US) 68112

( * ) Notice: Subject to any disclaimer, the term of this patent is extended or adjusted under 35 U.S.C. 154(b) by 259 days.

(21) Appl. No.: 11/167,712

(22) Filed: Jun. 27, 2005

Related U.S. Application Data

(63) Continuation-in-part of application No. 11/132,553, filed on May 19, 2005, now Pat. No. 7,237,728.

(51) Int. Cl.
*B05B 7/26* (2006.01)

(52) U.S. Cl. ..... 239/310; 239/318; 239/316; 239/354; 239/417.5; 251/207; 251/205; 137/605; 222/481; 222/481.5; 222/482

(58) Field of Classification Search ..... 239/310, 239/318, 347, 354, 417.5, 348, 407, 413, 239/414, 581.1; 251/205, 207; 137/605, 137/268; 222/481, 481.5, 482, 484
See application file for complete search history.

(56) References Cited

U.S. PATENT DOCUMENTS 2,113,203 A * 4/1938 Straubel ..... 137/599.15
3,034,731 A * 5/1962 Chapin ..... 239/318
3,090,564 A * 5/1963 Gilmour ..... 239/318
3,684,187 A * 8/1972 Etter ..... 239/414
3,764,074 A * 10/1973 James ..... 239/318
3,770,205 A * 11/1973 Proctor et al. ..... 239/317
3,940,069 A * 2/1976 Gunzel et al. ..... 239/318
3,998,227 A * 12/1976 Holbrook et al. ..... 604/119
4,033,509 A * 7/1977 Sheets ..... 239/226
4,057,940 A * 11/1977 Wemmer ..... 451/101
4,349,157 A * 9/1982 Beiswenger et al. ..... 239/509
4,369,921 A * 1/1983 Beiswenger et al. ..... 239/317
4,475,689 A * 10/1984 Hauger et al. ..... 239/318
4,553,423 A * 11/1985 Tanimoto ..... 73/1.03
4,600,130 A * 7/1986 Libit ..... 222/209
D284,988 S * 8/1986 Powell ..... D23/223
4,767,058 A * 8/1988 LaRosa et al. ..... 239/309
4,901,923 A * 2/1990 McRoskey et al. ..... 239/123
4,923,098 A * 5/1990 Schoonover et al. ..... 222/465.1
5,007,588 A * 4/1991 Chow et al. ..... 239/318
5,009,393 A * 4/1991 Massey ..... 251/207
5,039,016 A * 8/1991 Gunzel et al. ..... 239/314
5,100,059 A * 3/1992 Englhard et al. ..... 239/310
5,183,206 A * 2/1993 Gavin ..... 239/317
5,213,265 A * 5/1993 Englhard et al. ..... 239/310
5,303,729 A * 4/1994 DeMarco ..... 137/268
5,320,288 A * 6/1994 Ketcham, Jr. ..... 239/316
5,372,310 A * 12/1994 Ketcham ..... 239/317
5,375,769 A * 12/1994 Schultz ..... 239/310
5,383,603 A * 1/1995 Englhard et al. ..... 239/314
5,465,908 A * 11/1995 Kaneishi et al. ..... 239/571
5,595,345 A * 1/1997 Chura et al. ..... 239/312
H1691 H * 11/1997 Ono et al. ..... 239/3
5,804,082 A * 9/1998 Lowery, Jr. ..... 210/800
5,826,795 A * 10/1998 Holland et al. ..... 239/318
5,850,973 A * 12/1998 Liljeqvist et al. ..... 239/312
5,853,114 A * 12/1998 Giovanoli ..... 222/479

(Continued)

*Primary Examiner*—Kevin Shaver
*Assistant Examiner*—Trevor McGraw
(74) *Attorney, Agent, or Firm*—Thomte Law Office; Dennis L. Thomte

(57) ABSTRACT

A hand-held dispenser for precisely controlling the flow rate of water therethrough and for precisely controlling the metering of a liquid chemical into the water passing through the apparatus.

5 Claims, 10 Drawing Sheets

U.S. PATENT DOCUMENTS 5,944,259 A * 8/1999 Brown ..... 239/414
5,954,272 A * 9/1999 Liao ..... 239/317
5,957,387 A * 9/1999 Porta et al. ..... 239/312
6,012,650 A * 1/2000 Hadar ..... 239/317
6,068,204 A * 5/2000 Alexander ..... 239/310
6,102,308 A * 8/2000 Steingass et al. ..... 239/424.5
6,116,521 A * 9/2000 Miyake ..... 239/310
6,179,226 B1 * 1/2001 Jen ..... 239/310
6,182,911 B1 * 2/2001 Hanks et al. ..... 239/318
6,187,186 B1 * 2/2001 Zhadanov et al. ..... 210/198.1
6,233,756 B1 * 5/2001 Holbrook, Sr. ..... 4/601
6,240,983 B1 * 6/2001 Beldham et al. ..... 141/100
6,254,015 B1 * 7/2001 Abplanalp ..... 239/318
6,267,303 B1 * 7/2001 Francis ..... 239/318
6,283,385 B1 * 9/2001 Beaver et al. ..... 239/10
6,345,773 B1 * 2/2002 Shanklin et al. ..... 239/318
6,371,385 B1 * 4/2002 Schiller et al. ..... 239/310
6,378,785 B1 * 4/2002 Dodd ..... 239/318
6,397,879 B1 * 6/2002 Ring et al. ..... 137/268
6,419,166 B1 * 7/2002 Brzezinski et al. ..... 239/310
6,425,534 B2 * 7/2002 Ketcham et al. ..... 239/316
6,461,361 B1 * 10/2002 Epstein ..... 606/82
6,471,141 B2 * 10/2002 Smith et al. ..... 239/10
6,571,824 B2 * 6/2003 Jones et al. ..... 137/597
6,578,776 B1 * 6/2003 Shanklin et al. ..... 239/318
6,604,546 B1 * 8/2003 Gilmore ..... 137/550
D484,572 S * 12/2003 Shanklin et al. ..... D23/249
6,672,520 B2 * 1/2004 Shanklin et al. ..... 239/318
6,708,901 B2 * 3/2004 Hubmann et al. ..... 239/310
6,715,643 B1 * 4/2004 Kelly ..... 222/82
6,726,123 B2 * 4/2004 Wang ..... 239/310
6,749,133 B1 * 6/2004 Ketcham et al. ..... 239/318
6,749,135 B2 * 6/2004 Groblebe et al. ..... 239/526
6,752,297 B1 * 6/2004 Ische ..... 222/464.7
6,772,966 B2 * 8/2004 Foster et al. ..... 239/581.2
D497,975 S * 11/2004 Chen ..... D23/225
6,827,293 B2 * 12/2004 Seeman ..... 239/310
6,869,028 B2 * 3/2005 Bartsch et al. ..... 239/315
6,913,209 B2 * 7/2005 Shanklin et al. ..... 239/318
6,948,451 B2 * 9/2005 Bond et al. ..... 119/665

* cited by examiner

HAND-HELD DISPENSER

CROSS-REFERENCE TO RELATED APPLICATION

This is a continuation-in-part application of Petitioner's earlier application Ser. No. 11/132,553 filed May 19, 2005 now U.S. Pat. No. 7,237,728, entitled "HAND-HELD DISPENSER".

BACKGROUND OF THE INVENTION

1. Field of the Invention

This invention relates to a hand-held dispenser and more particularly to a hand-held dispenser which is capable of controlling the flow rate of water therethrough and for controlling the metering of a liquid chemical into the water passing through the dispenser.

2. Description of the Related Art

Many types of dispensers have been previously provided which may be connected to the end of a water hose or the like wherein the device introduces chemicals into the water flow so that a lawn or the like may be sprayed. The devices of the prior art are also able to inject liquid chemicals into a water stream so that a mop bucket, etc., may be filled with water, detergent or other chemicals.

To applicant's knowledge, none of the prior art devices are able to conveniently and economically precisely control the rate of water flow through the device but to also precisely control the metering of liquid chemicals into the precisely controlled flow of water.

In applicant's co-pending application, a solution to the problems of the prior art is disclosed. The instant invention is believed to be an improvement in the invention of the co-pending application. Although the invention of applicant's co-pending application has been well-accepted, it has been found that certain customers have a preference for a single flow rate of water through the spool member such as two gallons per minute but some of those same customers desire to have at least two chemical injection rates for dispensing into the water available to them.

SUMMARY OF THE INVENTION

A hand-held dispenser is described for precisely controlling the flow rate of water therethrough and for precisely controlling the metering of a liquid chemical into the water passing through the apparatus. The apparatus of this invention comprises a body member which includes a generally horizontally disposed first body portion having opposite sides, an inlet end, a discharge end, and a first fluid passageway extending between the inlet and discharge ends. The first body portion has a transversely extending spool opening formed thereon which extends between the opposite sides thereof and which communicates with the first fluid passageway. The inlet end of the first body portion is adapted to be secured to a source of water under pressure.

A spool member is mounted in the spool opening and has an inlet end, an outlet end, an upper end, a lower end, and first and second sides. The spool member has a second fluid passageway extending between its inlet end and its outlet end which communicates with the first fluid passageway. The spool member has a third fluid passageway formed therein which extends from the second fluid passageway to the lower end of the spool member.

The body member also includes a generally vertically extending second body portion, having upper and lower ends, and first and second sides. The second body portion has a transversely extending, horizontally disposed cylindrical bore, having first and second ends, formed therein below the spool opening which extends between the first and second sides of the second body portion. The body member also has a fourth fluid passageway formed therein which extends downwardly from the spool opening to the cylindrical bore. The second body portion also has a fifth fluid passageway formed therein which extends from the cylindrical bore to the lower end of the second body portion. The fifth fluid passageway is in communication with a source of liquid chemical.

A cylindrical chemical metering valve, having first and second ends, is selectively rotatably mounted in the cylindrical bore and is rotatable between first and second positions. The metering valve has radially spaced-apart first and second transversely extending metering passageways formed therein, each of which has an inlet end a discharge end. The first and second metering passageways permit different chemical flow rates therethrough due to the different sized metering tips associated therewith.

When the metering valve is in its first position, the inlet end of the first metering passageway is in fluid communication with the fifth fluid passageway and the discharge end of the first metering passageway is in fluid communication with the fourth fluid passageway. When the metering valve is in its second position, the inlet end of the second metering passageway is in fluid communication with the fifth fluid passageway and the discharge end of the second metering passageway is in fluid communication with the fourth fluid passageway.

Thus, the liquid chemical may be injected into the flow of water passing through the first body portion at two different rates depending upon whether the metering valve is in its first position or in its second position.

It is therefore a principal object of the invention to provide an improved chemical dispenser.

Still another object of the invention is to provide an improved hand-held dispenser which dispenses chemicals mixed with water.

Yet another object of the invention is to provide a dispenser of the type described which enables the precise controlling of the flow rate of water therethrough and the precise metering of a liquid chemical into the water passing through the dispenser.

Still another object of the invention is to provide a hand-held dispenser which is either disposable or reusable.

Still another object of the invention is to a dispenser which permits chemicals to be injected into a flow of water passing therethrough in two different rates.

Still another object of the invention is to provide a dispenser which is economical of manufacture, durable in use and refined in appearance.

These and other objects will be obvious to those skilled in the art.

DETAILED DESCRIPTION OF THE INVENTION

Figure 1:
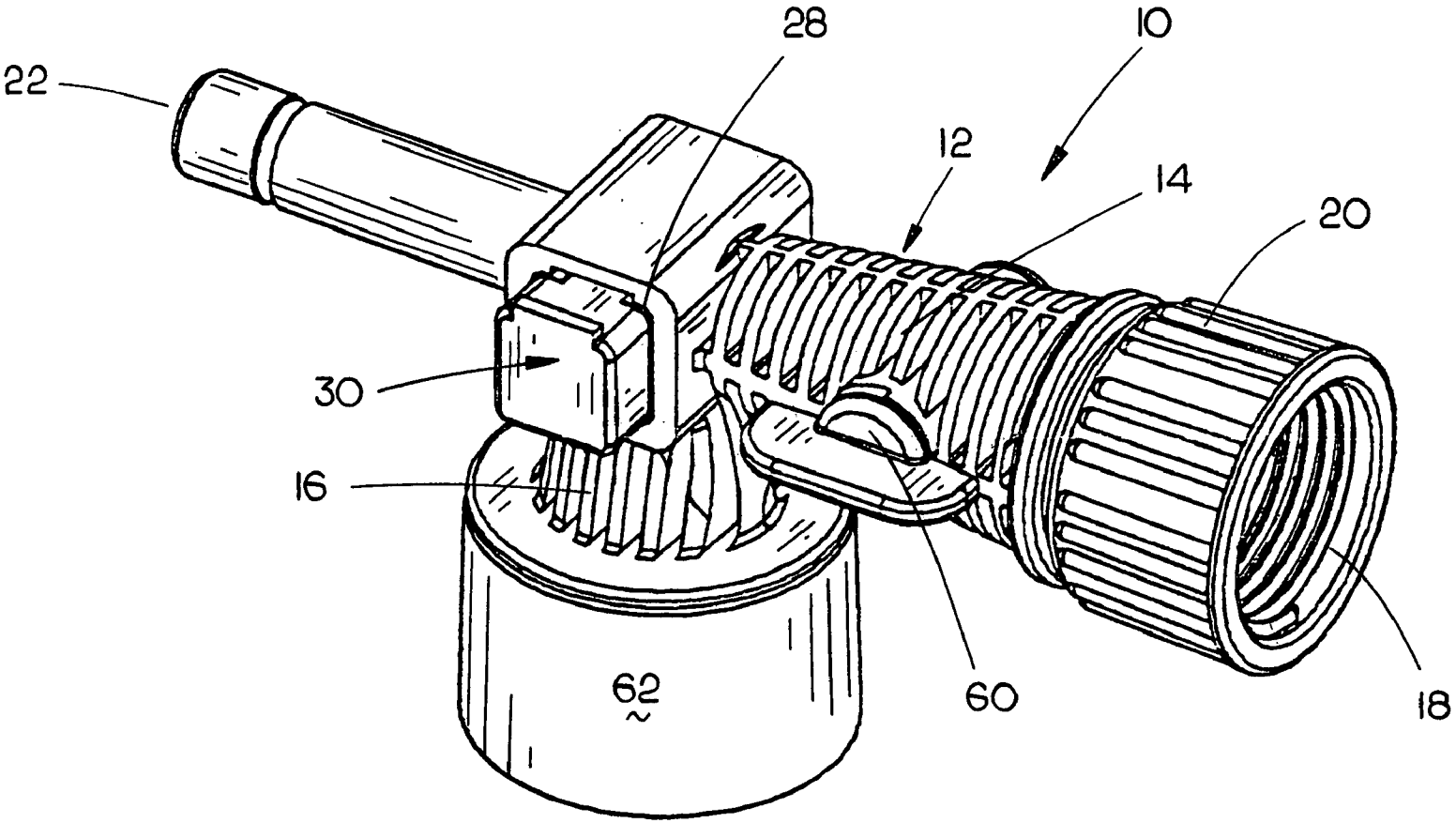
FIG. 1 is perspective view of the dispenser of the co-pending application.
Figure 2:
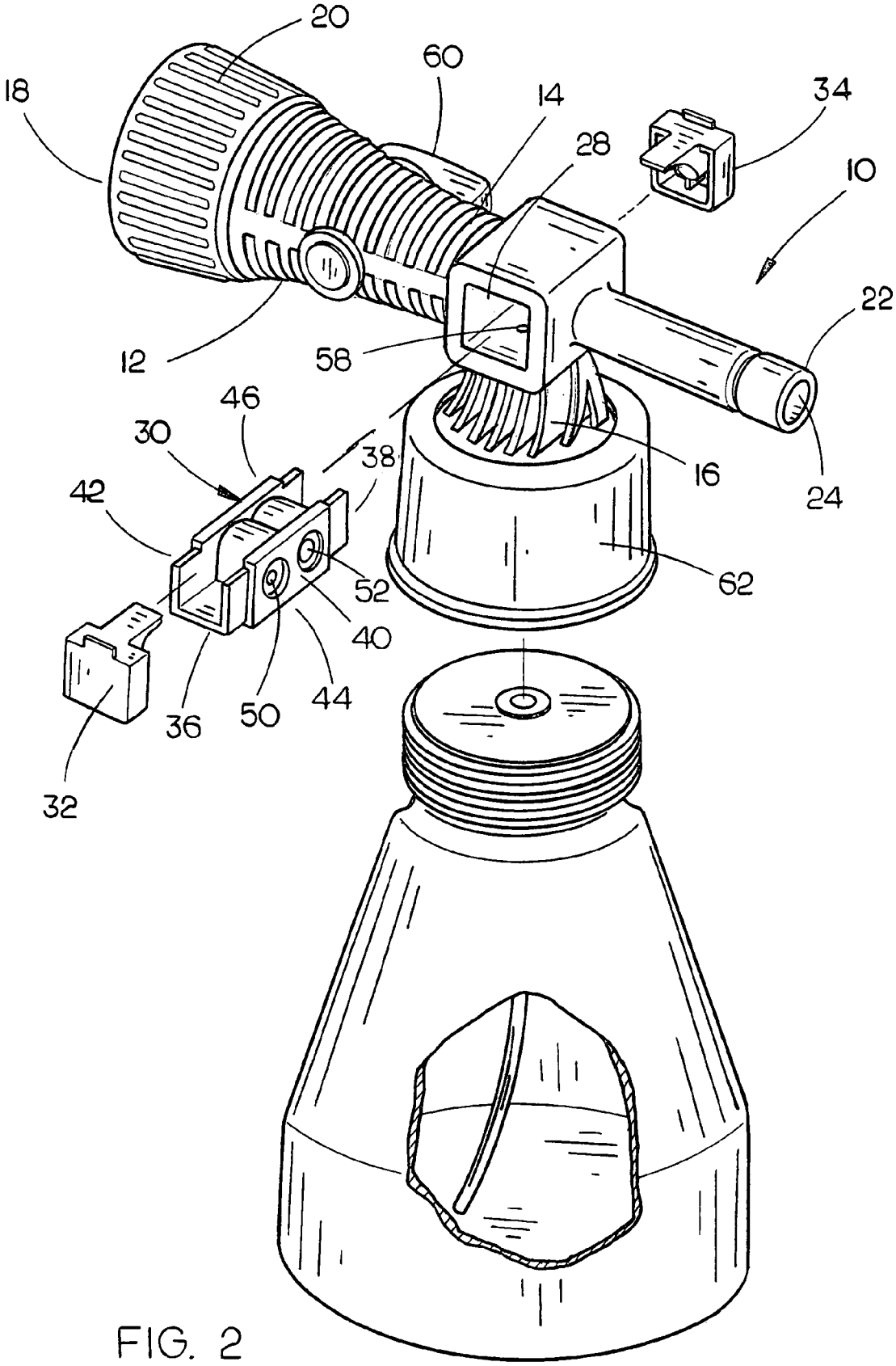
FIG. 2 is an exploded perspective view of the dispenser of the co-pending application.
Figure 3:
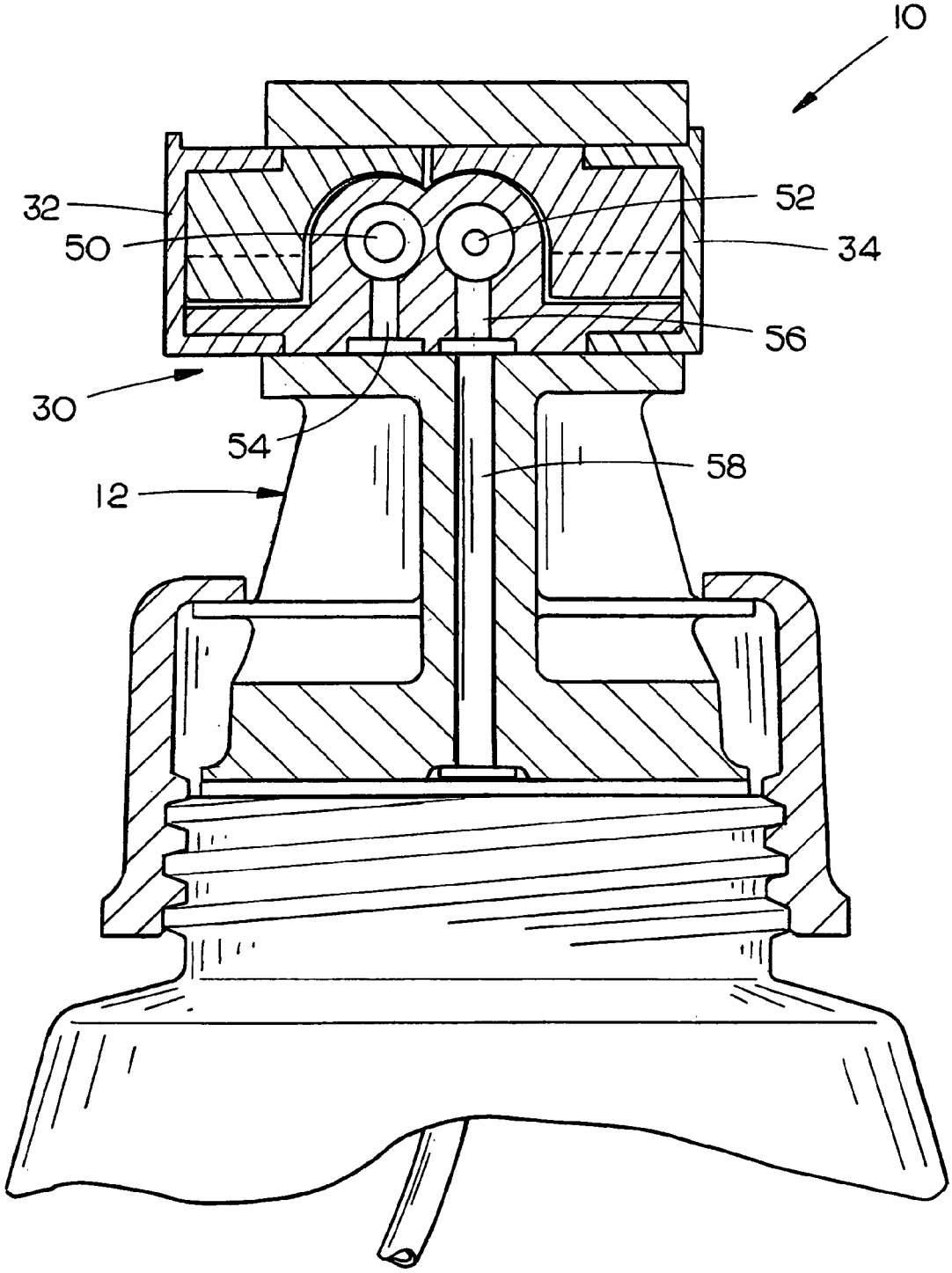
FIG. 3 is a vertical sectional view of the dispenser of the co-pending application.
Figure 4:
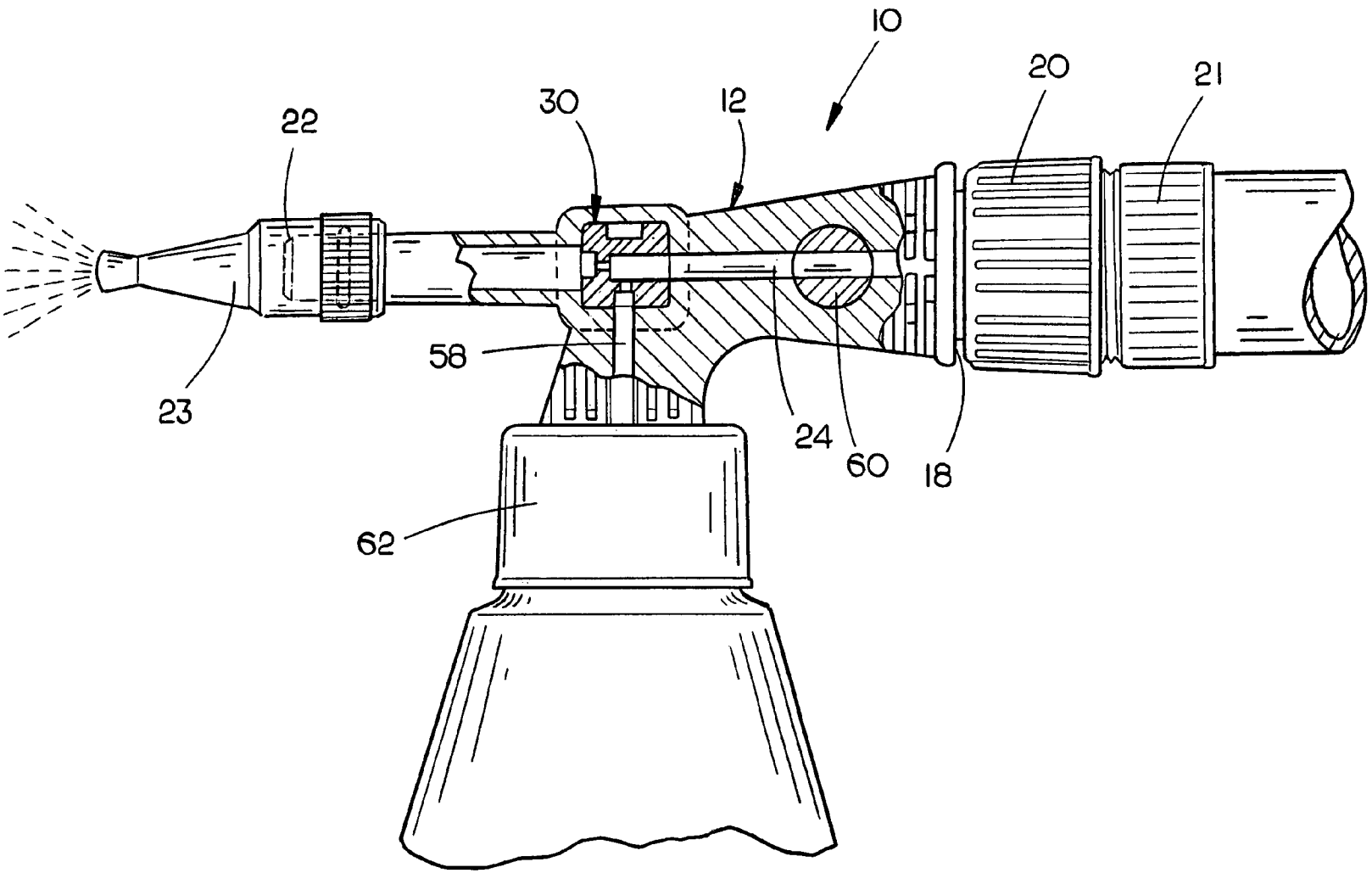
FIG. 4 is a partial sectional view of the dispenser of the co-pending application.
Figure 5:
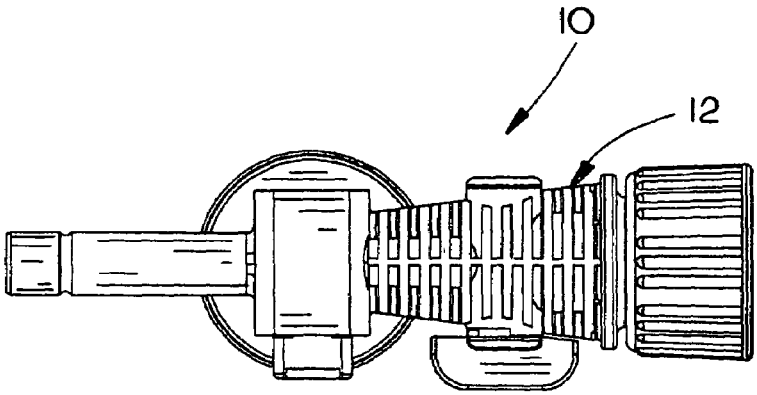
FIG. 5 is a top view of the dispenser of the co-pending application.
Figure 6:
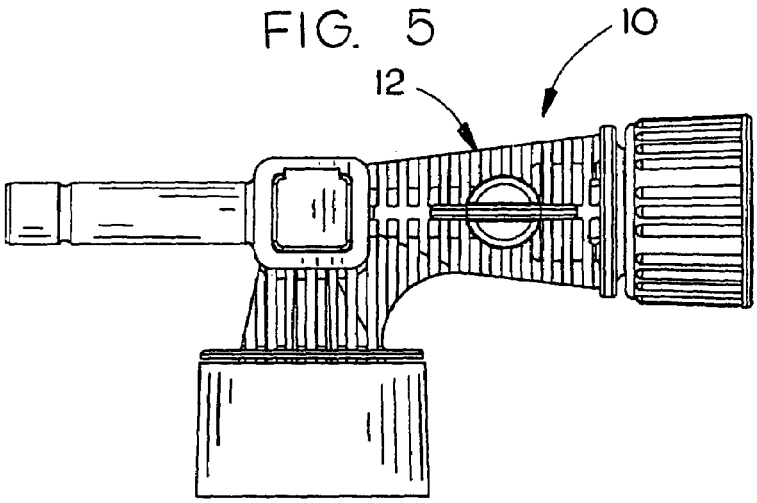
FIG. 6 is a side view of the dispenser of the co-pending application.
Figure 7:
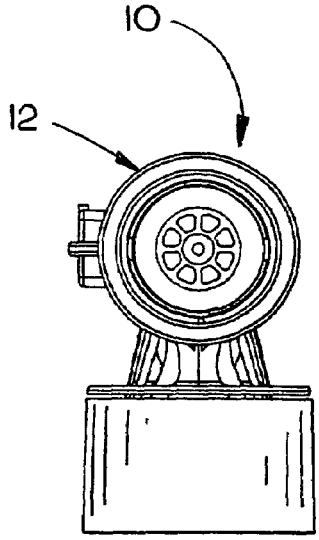
FIG. 7 is an end view of the dispenser of the co-pending application as seen from the right of FIG. 6.
Figure 8:
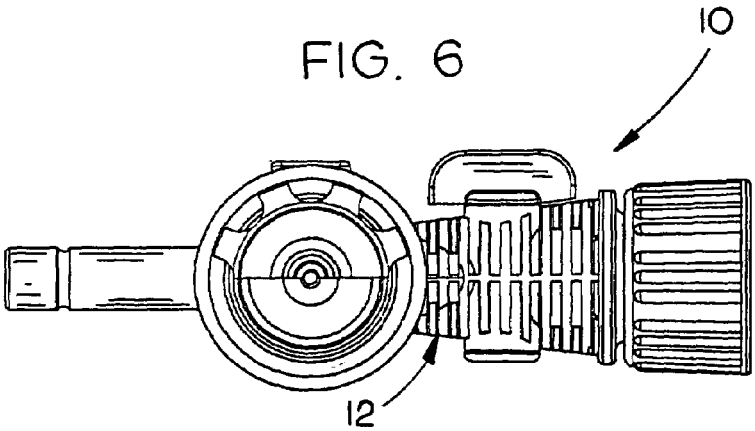
FIG. 8 is a bottom view of the dispenser of the co-pending application.
Figure 9:
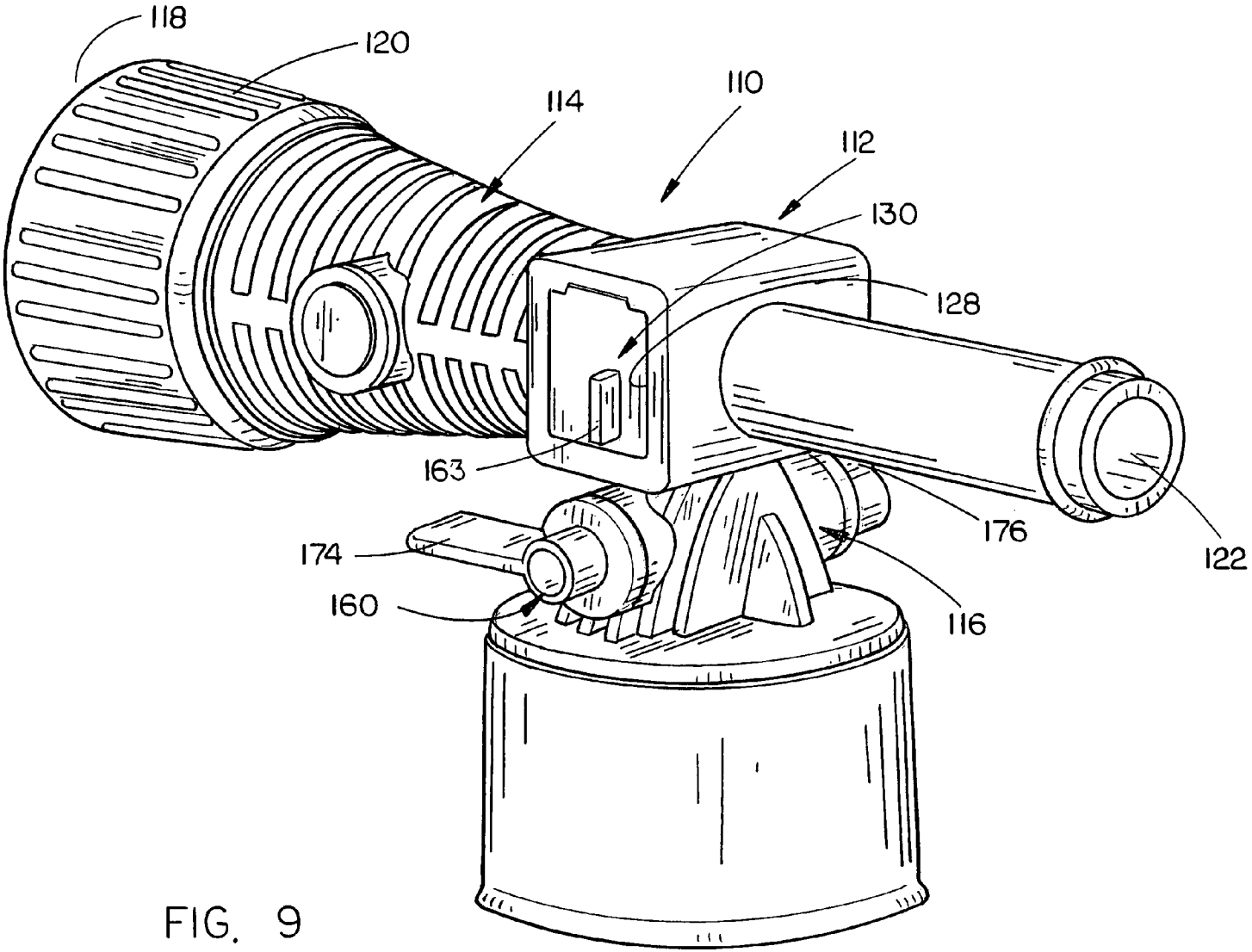
FIG. 9 is a perspective view of the dispenser of this invention.
Figure 10:
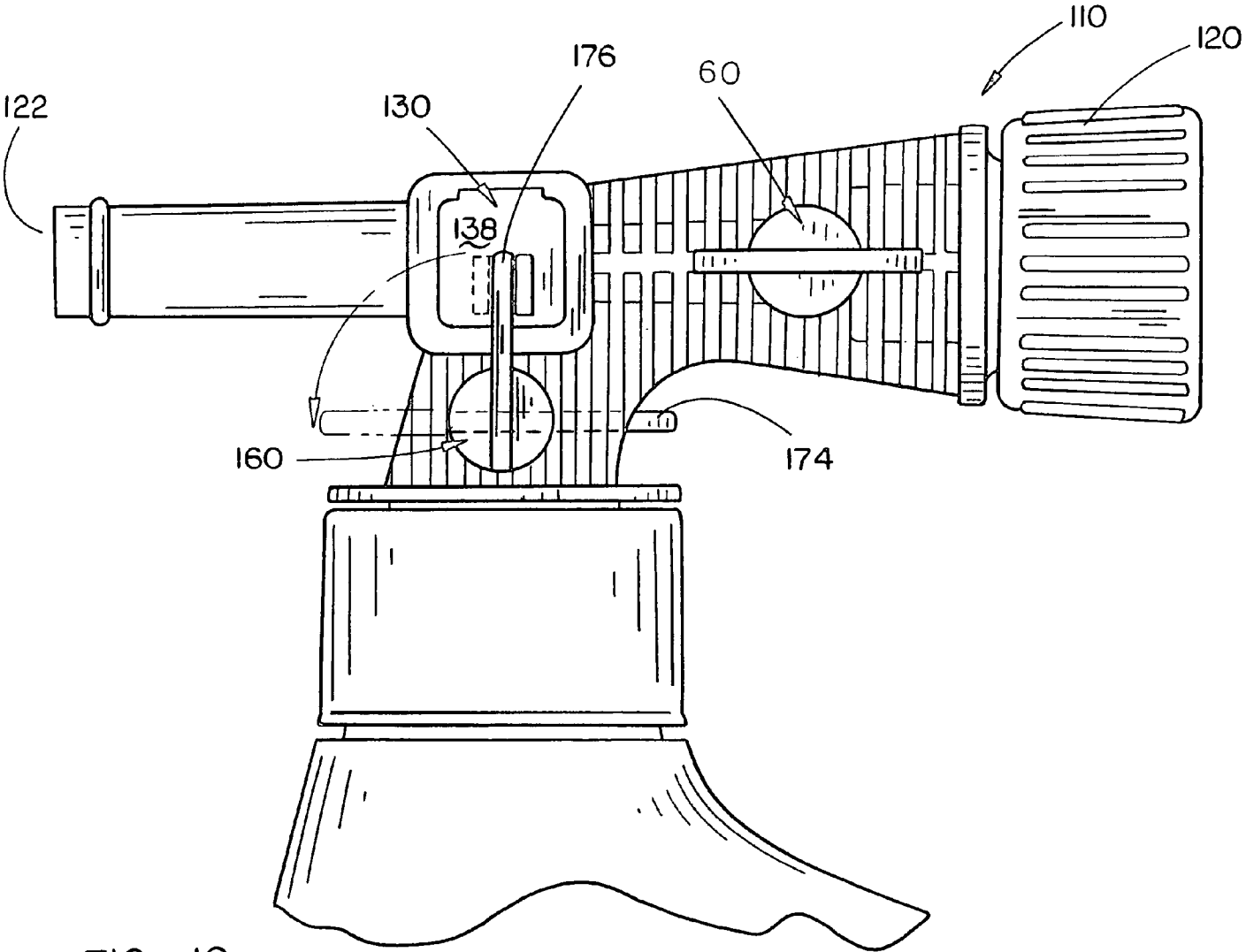
FIG. 10 is a side view of the dispenser of this invention.
Figure 11:
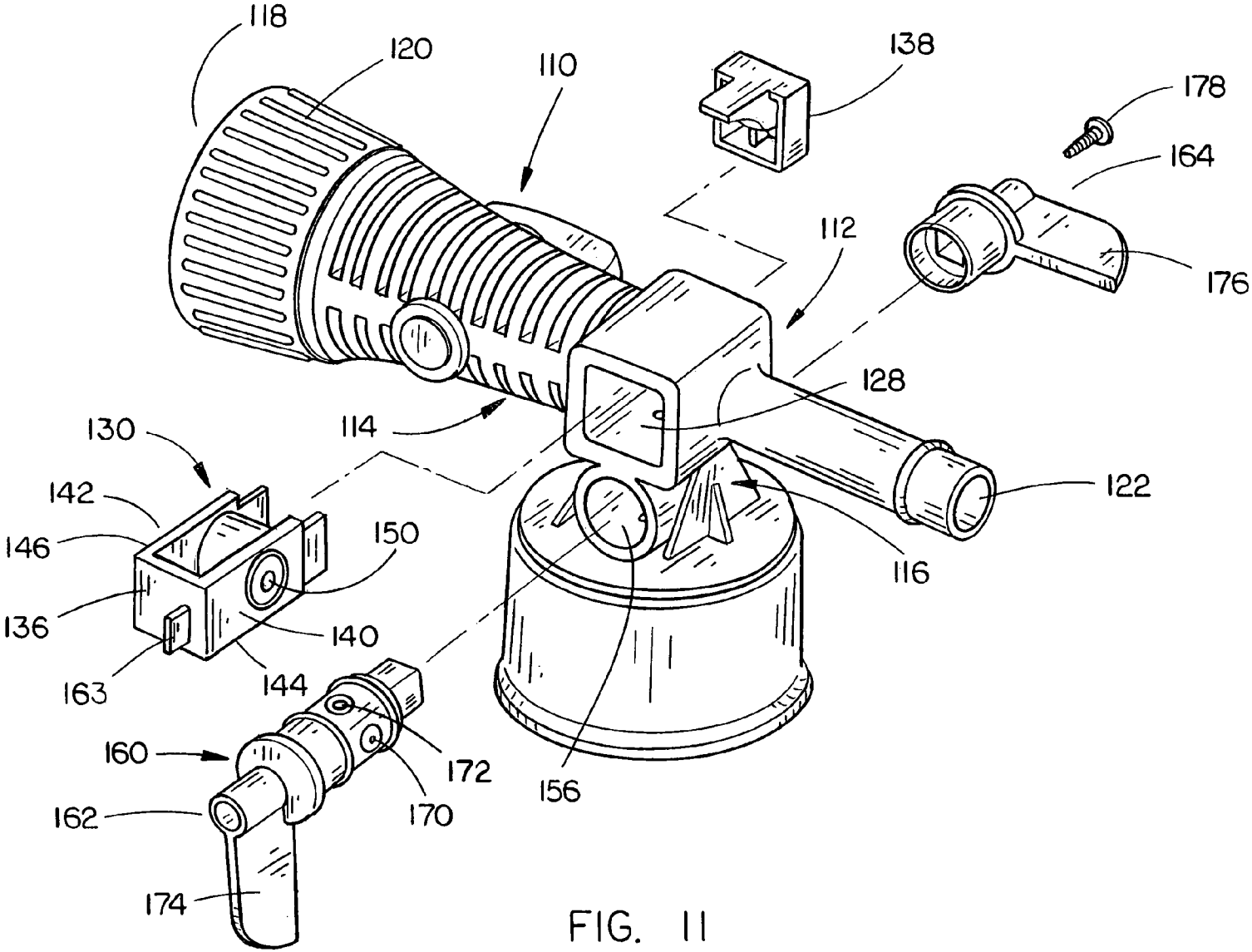
FIG. 11 is an exploded perspective view of the dispenser of this invention.

The dispenser of the co-pending application is illustrated in FIGS. 1-8 while the dispenser of the instant application is illustrated in FIGS. 9-13. In FIGS. 1-8, the dispenser of the co-pending application is referred to generally by the reference numeral 10 and is preferably of the hand-held type. Dispenser 10 includes a dispenser body 12 which is generally T-shaped in configuration and which includes a generally horizontally disposed body portion 14 and a generally vertically disposed body portion 16. Obviously, body portion 14 will not always be horizontally disposed when being used nor will body portion 16 always be substantially vertically disposed when in use.

Body portion 14 includes an inlet end 18 which preferably has a rotatable dispenser nut or connector 20 mounted thereon so that a water hose or the like may be secured thereto with the water hose being in communication with a source of water under pressure. It is preferred that a backflow preventer 21 of conventional design be imposed between the water hose and the inlet end 18. The outlet or discharge end 22 of the body portion 14 may have any type of spray deflector nozzle 23 or the like mounted thereon, if so desired. Body portion 14 includes a first fluid passageway 24 extending from the inlet end 18 to the discharge end or outlet end 22.

Body portion 14 is provided with a transversely extending spool opening 28 which intersects and which is in communication with the fluid passageway 24. An elongated, preferably rectangular in cross section, spool 30 is slidably mounted in spool opening 28 and is movable between at least first and second positions. Spool 30 is provided with end caps 32 and 34 mounted on the opposite ends thereof which are removably mounted thereon and which limit the movement of the spool 30 with respect to the body portion 14. For purposes of description, spool 30 will be described as having opposite ends 36 and 38, opposite sides 40 and 42, a lower end 44 and an upper end 46.

At least two water flow control passageways 50 and 52 extend between sides 40 and 42 and have different diameters. At least two chemical flow passageways 54 and 56 extend upwardly into spool 30 from the lower end thereof so as to be in fluid communication with the water flow control passageways 50 and 52, respectively. The chemical flow passageways 54 and 56 have different diameters.

When spool 30 is in its first position, water flow control passageway 50 is in fluid communication with the first fluid passageway 24 and the chemical flow passageway 54 will be in fluid communication with water flow control passageway 50. When spool 30 is in its second position, water flow control passageway 52 is in communication with the first fluid passageway 24 and the chemical flow passageway 56 will be in communication with water flow control passageway 52.

The vertically disposed body portion 16 is provided with a second fluid passageway 58 extending therethrough with the upper end thereof being in communication with the spool opening 28. The numeral 60 refers to a rotary on-off valve which extends transversely through the first fluid passageway 24 so that the flow of water therethrough may be controlled.

The numeral 62 refers to a rotating collar mounted on the lower end of body portion 16 to enable the dispenser to be connected to a conventional chemical container.

With a liquid chemical container having liquid chemical therein is secured to the collar 62 and with the dispenser on-off valve 60 in its open position, and with the dispenser spool in its first position, liquid chemical will be drawn upwardly through the second fluid passageway 58 as water passes through first fluid passageway 24. The liquid chemical in second fluid passageway 58 will pass through chemical flow passageway 54, water flow control passageway 50 and into fluid passageway 24. With the spool 30 in its second position, liquid chemical will be drawn upwardly through the fluid passageway 58, through chemical flow passageway 56, through water flow control passageway 52 and into fluid passageway 24. By providing the dispenser spool 30 with the water flow control passageways 50, 52 and the chemical flow passageways 54, 56, the chemical added to the water is precisely metered depending upon the diameters of the chemical flow passageways 54 and 56. The flow of water through the dispenser is precisely controlled through the use of the variable diameter water flow control passageways 50 and 52. Although the dispenser spool 30 is described as having a pair of chemical flow passageways and a pair of water flow control passageways formed therein, the dispenser spool 30 could be provided with additional sets of chemical flow passageways and water flow control passageways with the dispenser spool being selectively movable between a plurality of operating positions.

Referring now to the invention of this application, and more particularly to FIGS. 9-13, the dispenser of the instant application is referred to generally by the reference numeral 110 and is preferably of the hand-held type. Dispenser 110 includes a dispenser body 112 which is generally T-shaped in configuration and which includes a generally horizontally disposed body portion 114 and a generally vertically disposed body portion 116. Obviously, body portion 114 will not always be horizontally disposed when being used nor will body portion 116 always be substantially vertically disposed when in use.

Figure 12:
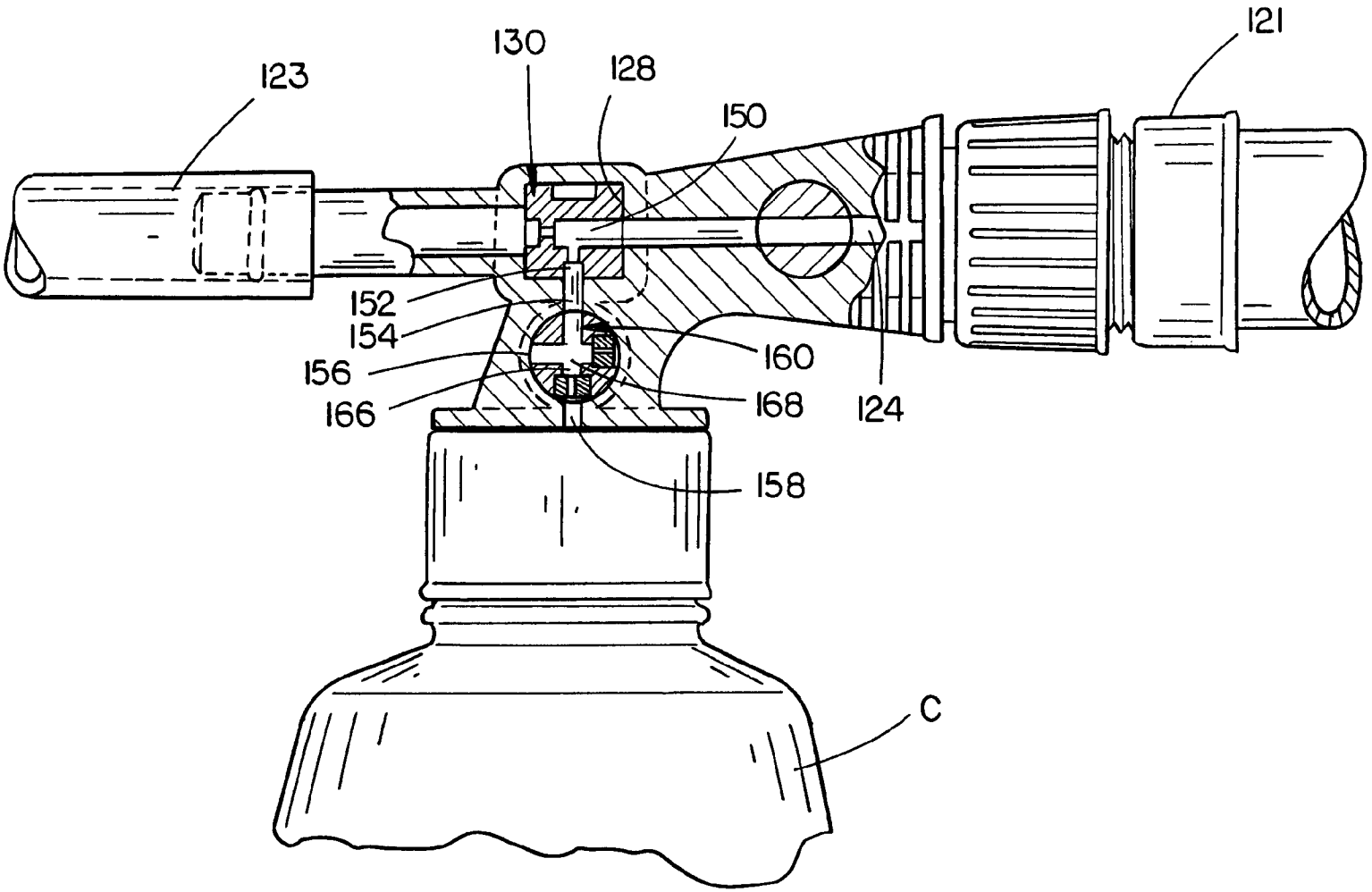
FIG. 12 is a side view of the dispenser of this invention with portions thereof cut away to more fully illustrate the invention.
Figure 13:
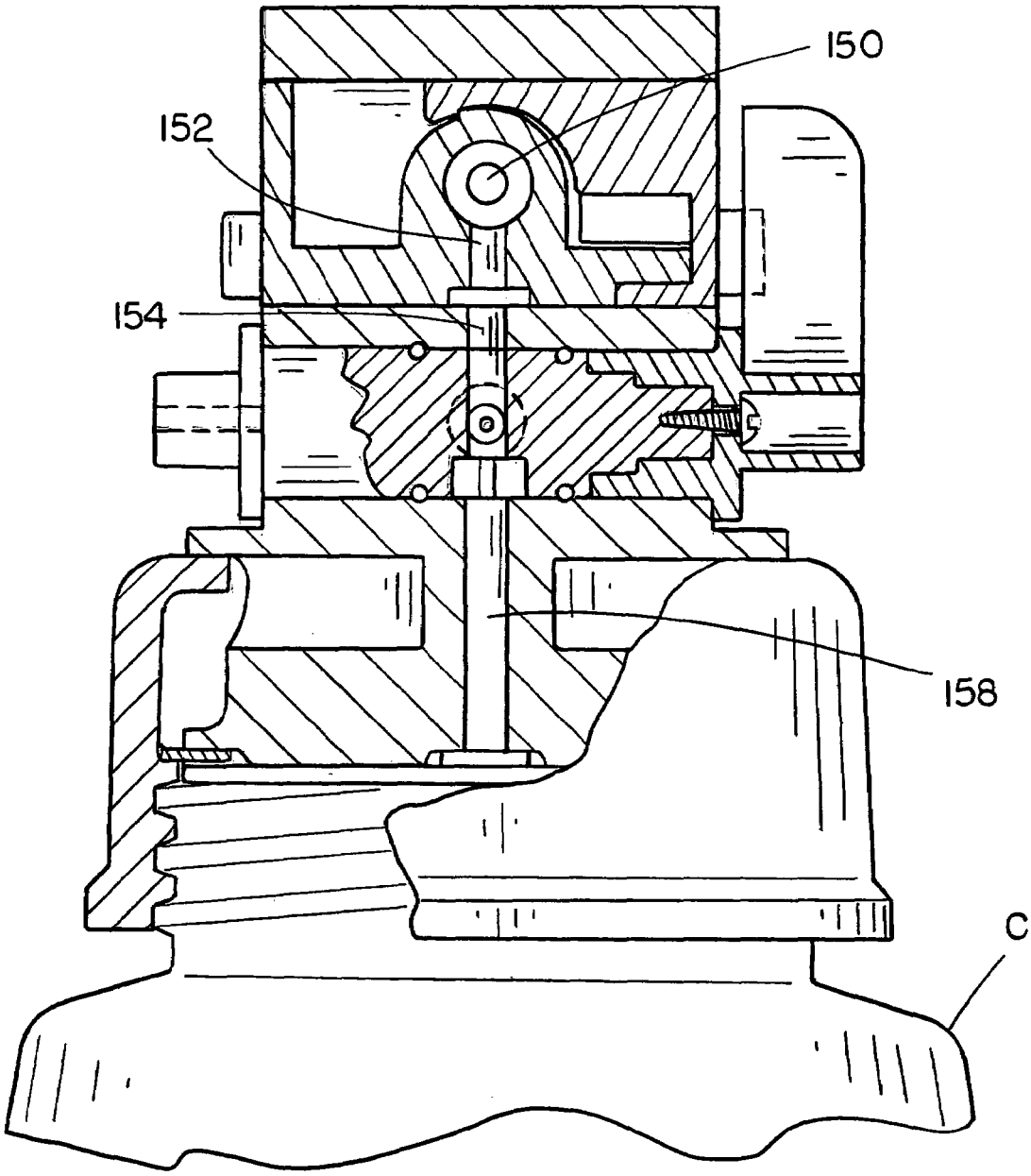
FIG. 13 is an end view of the dispenser of this invention with portions thereof cut away to more fully illustrate the invention.

Body portion 114 includes an inlet end 118 which preferably has a rotatable dispenser nut or connector 120 mounted thereon so that a water hose or the like may be secured thereto with the water hose being in communication with a source of water under pressure. It is preferred that a backflow preventer 121 of conventional design be imposed between the water hose and the inlet end 118. The outlet or discharge end 122 of the body portion 114 may have any type of spray deflector nozzle 123 or the like mounted thereon, if so desired, as seen in FIG. 12. Body portion 114 includes a first fluid passageway 124 extending from the inlet end 118 to the discharge end or outlet end 122.

Body portion 114 is provided with a transversely extending spool opening 128 which intersects and which is in communication with the fluid passageway 124. An elongated, preferably rectangular in cross section, spool 130 is selectively removably mounted in spool opening 128. For purposes of description, spool 130 will be described as having opposite ends 136 and 138, opposite sides 140 and 142, a lower end 144 and an upper end 146.

A second fluid passageway 150 extends between the inlet end and outlet end of the spool member 130 which communicates with the first fluid passageway 124. The spool member 130 has a third fluid passageway 152 formed therein which extends from the second fluid passageway 150 to the lower end of the spool member 130. The body 112 has a fourth fluid passageway 154 formed therein which extends downwardly from the spool opening 128 to a cylindrical bore 156 which is formed in body portion 116 below spool opening 128. The second body portion 116 has a fifth fluid passageway 158 formed therein which extends from the cylindrical bore 156 to the lower end of the back portion 116. The fifth fluid passageway 158 is in communication with a source of liquid chemical contained within container C which is connected to the lower end of body portion 116.

A cylindrical chemical metering valve 160, having end portions 162 and 164, is selectively rotatably mounted in the cylindrical bore 156 and is rotatable between first and second positions. The metering valve 160 has radially spaced-apart first and second transversely extending metering passageways 166 and 168, respectively, formed therein each of which has an inlet end and a discharge end. Metering tips 170 and 172 are mounted in the discharge ends of the metering passageways 166 and 168, respectively, which permit different chemical flow rates therethrough. In other words, the orifices of the metering tips 170 and 172 have different diameters.

Handle 174 is mounted on end portion 162 of valve 160 while handle 176 is mounted on end portion 164 of valve 160. End portions 162 and 164 are secured together by a screw 178 so that handles 174 and 176 are disposed at right angles to one another. Valve 160 is selectively rotatable between first and second positions relative to the spool 130. When valve 160 is in its first position of FIGS. 9 and 10, handle 176 will be horizontally disposed and spaced from the stop 163. which extends outwardly from end portion 136 of spool 130 and handle 176 will be in engagement with stop 163 which extends outwardly from end portion 138 of spool 130. In the first position, metering passageway 168 will be in communication with passageways 154 and 158. In the second position of valve 160, handle 174 will be in engagement with stop 163 and handle 176 will be horizontally disposed. In the second position, metering passageway 166 will be in communication with passageways 154 and 158.

Thus, the dispenser 110 permits the user to pass water through the body at a particular flow rate which will depend upon the diameter of the passageway 124. The user can select the chemical injection rate between two options available to the user by simply rotating valve 160 between its two positions. If the user desires a different water flow rate, the spool 130 may be replaced by a spool having a different diameter passageway extending therethrough.

Thus it can be seen that the invention accomplishes at least all of its stated objectives.

I claim:

1. A hand-held dispenser apparatus for controlling the flow rate of water therethrough and for controlling the metering of a liquid chemical into the water passing through the apparatus, comprising:

a body member;

said body member including a generally horizontally disposed first body portion having first and second sides, an inlet end, a discharge end, and a first fluid passageway, having inlet and discharge ends, extending between said inlet and discharge ends of said first body portion;

said inlet end of said first fluid passageway adapted to be secured to a source of water under pressure;

said first body portion having a transversely extending spool opening formed therein which extends between said first and second sides thereof and which communicates with said first fluid passageway;

a spool member mounted in said spool opening and having an inlet end, an outlet end, an upper end, a lower end, and first and second sides;

said spool member having a second fluid passageway extending between its said inlet and outlet ends which communicates with said first fluid passageway;

said spool member having a third fluid passageway formed therein which extends from said second fluid passageway to said lower end of said spool member;

said body member also including a vertically extending second body portion, having upper and lower ends and first and second sides;

said second body portion having a transversely extending, horizontally disposed cylindrical bore, having first and second ends, formed therein below said spool opening which extends between said first and second sides thereof;

said body member having a fourth fluid passageway formed therein which extends downwardly from said spool opening to said cylindrical bore;

said second body portion having a fifth fluid passageway formed therein which extends from said cylindrical bore to said lower end thereof;

said fifth fluid passageway being in communication with a source of liquid chemical;

a cylindrical chemical metering valve, having first and second ends, selectively rotatably mounted in said cylindrical bore and being rotatable between first and second positions;

said metering valve having radially spaced-apart first and second transversely extending metering passageways formed therein, each of which has an inlet end and a discharge end;

said first and second metering passageways permitting different chemical flow rates therethrough;

when said metering valve is in its said first position, said inlet end of said first metering passageway is in fluid communication with said fifth fluid passageway and said discharge end of said first metering passageway is in fluid communication with said fourth fluid passageway;

when said metering valve is in its second position, said inlet end of said second metering passageway is in fluid communication with said fifth fluid passageway and said discharge end of said second metering passageway is in fluid communication with said fourth fluid passageway;

wherein an elongated first valve handle is secured to said first end of said metering valve and wherein an elongated second valve handle is secured to said second end of said metering valve;

said first and second valve handles are radially offset with respect to one another;

wherein a first stop is provided at said first end of said spool member which is in rotational path of said first valve handle and wherein a second stop is provided at said second end of said spool member which is in the rotational path of said of said second valve handle.

2. The dispenser apparatus of claim 1 wherein a metering tip is mounted in the discharge end of each of said first and second metering passageways.

3. The dispenser apparatus of claim 2 wherein each of said metering tips has a metering orifice provided therein.

4. The dispenser apparatus of claim 3 wherein said metering tips orifices have different diameters.

5. The dispenser of claim 1 wherein said metering valve is in its said first position when said first valve handle is in engagement with said first stop and wherein said metering valve is in its said second position when said second valve handle is in engagement with said second stop.

* * * * *